US010353323B2

(12) United States Patent
Aiba

(10) Patent No.: US 10,353,323 B2
(45) Date of Patent: Jul. 16, 2019

(54) IMAGE FORMING APPARATUS

(71) Applicant: CANON KABUSHIKI KAISHA, Tokyo (JP)

(72) Inventor: Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/467,109

(22) Filed: Mar. 23, 2017

(65) Prior Publication Data

US 2017/0308008 A1 Oct. 26, 2017

(30) Foreign Application Priority Data

Apr. 22, 2016 (JP) ..... 2016-086481

(51) Int. Cl.
*G03G 15/16* (2006.01)

(52) U.S. Cl.
CPC ..... *G03G 15/1665* (2013.01)

(58) Field of Classification Search
CPC .... G03G 15/16; G03G 15/161; G03G 15/167; G03G 15/0178; G03G 15/0189; G03G 15/1605; G03G 15/1665; G03G 15/1675
See application file for complete search history.

(56) References Cited

U.S. PATENT DOCUMENTS 8,805,219 B2 * 8/2014 Shibuya ..... G03G 15/0266 399/26
9,207,563 B2 12/2015 Fujioka
2001/0043817 A1 * 11/2001 Maebashl ..... G03G 15/0105 399/50
2008/0187334 A1 * 8/2008 Hano ..... G03G 15/0266 399/48
2012/0045230 A1 * 2/2012 Kawaguchi ..... G03G 15/0157 399/45
2017/0308017 A1 * 10/2017 Tomii ..... G03G 15/5058

FOREIGN PATENT DOCUMENTS

JP 2004-109616 A 4/2004
JP 2007-316622 A 12/2007
JP 2009-192901 A 8/2009
JP 2012-189690 A 10/2012
JP 2013-109378 A 6/2013
JP 2014-021261 A 2/2014

* cited by examiner

*Primary Examiner* — Francis C Gray
(74) *Attorney, Agent, or Firm* — Venable LLP

(57) ABSTRACT

An image forming apparatus includes a control unit configured to execute a first mode and a second mode of forming images on first through third image bearing members. In the first mode, a toner image is formed on a third image bearing member without having toner images formed on the first and second image bearing members in a state where the first through third image bearing members are abutted against an intermediate transfer body. In the first mode, the control unit controls at least a first charging device such that a primary transfer contrast in a first primary transfer portion is set to be equal to or greater than a discharge starting voltage, and applies an AC voltage to a second charging device such that a discharge current having a current quantity smaller than that in the second mode is supplied.

17 Claims, 11 Drawing Sheets

FIG.6

| TEMPERATURE [°C] | HUMIDITY [%] | ABSOLUTE MOISTURE CONTENT [g/m³] | GHOST EVALUATION RESULT (○ GOOD: NO GHOST OCCURRED △ AVERAGE: SLIGHT GHOST OCCURRED × POOR: GHOST OCCURRED) | |
|---|---|---|---|---|
| | | | NORMAL MONOCHROME MODE | GHOST COUNTERMEASURE MODE |
| 30 | 80 | 21.7 | ○ | ○ |
| 23 | 50 | 8.8 | ○ | ○ |
| 23 | 30 | 5.3 | ○ | ○ |
| 15 | 45 | 4.8 | △ | ○ |
| 23 | 15 | 2.7 | × | ○ |
| 15 | 10 | 1.1 | × | ○ |
| 23 | 5 | 0.9 | × | ○ |

IMAGE FORMING APPARATUS

BACKGROUND OF THE INVENTION

Field of the Invention

The present invention relates to an image forming apparatus adopting an electrophotographic process, such as a copying machine, a printer, a facsimile machine, or a multifunctional device having multiple functions.

Description of the Related Art

Heretofore, an image forming apparatus adopting a configuration in which a toner image formed on a photosensitive drum serving as an image bearing member is primarily transferred to an intermediate transfer belt serving as an intermediate transfer body, and thereafter, the image is secondarily transferred to a recording material is known. Japanese Unexamined Patent Application Publication Nos. 2009-192901 and 2007-316622 propose an intermediate transfer belt in which a conductive agent is added to a resin material, such that a resistance value is adjusted to the intended value.

On the other hand, hereafter, a configuration of a so-called tandem-type intermediate transfer system in which a plurality of photosensitive drums are arranged in a direction of rotation of the intermediate transfer belt has been known as an image forming apparatus. A configuration is also heretofore known in which a full color mode where all the photosensitive drums are abutted against the intermediate transfer belt to form images and a single color mode where only one photosensitive drum is abutted against the intermediate transfer belt to form images are executed.

In the single color mode, the number of photosensitive drums that abut against the intermediate transfer belt is small compared to the full color mode, such that the restraining force of the intermediate transfer belt is weak, and image defects may be caused. Therefore, Japanese Unexamined Patent Application Publication No. 2013-109378 proposes a configuration in which, even in a single color mode, the photosensitive drums that do not form toner images are also abutted against the intermediate transfer belt, and a primary transfer bias is applied to a primary transfer portion formed between the photosensitive drum and the intermediate transfer belt.

In a state where the intermediate transfer belt is subjected to secondary transfer bias at a secondary transfer portion where a toner image is transferred from the intermediate transfer belt to a recording material, if a subsequent primary transfer operation is carried out while the charge on the intermediate transfer belt is not sufficiently attenuated, the toner image on the photosensitive drum is influenced by the residual electric charge on the intermediate transfer belt prior to the photosensitive drum being in contact with the intermediate transfer belt. Then, in a state where a portion of the toner image is transferred to the intermediate transfer belt, scattering may occur, which may cause image unevenness and image defects, so-called ghosts.

Especially in a state where image forming is performed in a single color mode, if a primary transfer bias is not applied at an upstream primary transfer portion, residual electric charge may not be relieved, and scattering tends to occur. Especially in the case of a single color mode using black toner, ghosts caused by scattering tend to stand out.

According to Japanese Unexamined Patent Application Publication No. 2013-109378, even during a single color mode, a primary transfer bias is applied at a primary transfer portion formed between the photosensitive drum not forming the toner image and the intermediate transfer belt on an upstream side of the photosensitive drum forming the toner image. Therefore, ghosts caused by scattering rarely occur even during the single color mode.

However, according to the configuration disclosed in Japanese Unexamined Patent Application Publication No. 2013-109378, charging unevenness may occur to the photosensitive drum during successive forming of images, due for example to the influence of application of primary transfer bias.

SUMMARY OF THE INVENTION

The present invention provides a configuration enabling to suppress the occurrence of scattering in a single color mode, and also enabling to suppress charging unevenness of an image bearing member that does not form a toner image.

According to first aspect of the present invention, an image forming apparatus includes first through third image bearing members respectively configured to bear toner images and rotate, first through third charging devices configured to respectively charge surfaces of the first through third image bearing members in a state where a charging bias having AC voltage superposed to DC voltage is applied, an rotatable intermediate transfer body configured to abut against the first through third image bearing members to form first through third primary transfer portions where toner images formed on the first through third image bearing members are respectively primarily transferred, in a state where a primary transfer bias is applied, a secondary transfer member configured to form a secondary transfer portion where the toner image formed on the intermediate transfer body is secondarily transferred to a recording material, in a state where a secondary transfer bias is applied, and a control unit configured to execute a first mode of forming a toner image on the third image bearing member arranged downstream, in a rotating direction of the intermediate transfer body, without having toner images formed on the first image bearing member and the second image bearing member, and of secondarily transferring the toner image formed on the third image bearing member to the recording material through the intermediate transfer body in a state where the first through third image bearing members are abutted against the intermediate transfer body, and a second mode of forming toner images on the first through third image bearing members, of primarily transferring the toner images on the intermediate transfer body so as to be superposed each other, and of secondary transferring the toner image on the intermediate transfer body to the recording material. In a state where the first mode is executed, the control unit controls at least the first charging device such that a primary transfer contrast in the first primary transfer portion is set equal to or greater than a discharge starting voltage, and applies an AC voltage to the second charging device such that a discharge current having a current quantity smaller than that in the second mode is supplied.

According to a second aspect of the present invention, an image forming apparatus includes first through third image bearing members respectively configured to bear toner images and rotate, first through third charging devices configured to respectively charge surfaces of the first through third image bearing members in a state where a charging bias having AC voltage superposed to DC voltage is applied, an rotatable intermediate transfer body configured to abut against the first through third image bearing members to form first through third primary transfer portions where toner images formed on the first through third image bearing members are respectively primarily transferred, in a state where a primary transfer bias is applied, a secondary transfer member configured to form a secondary transfer portion where the toner image formed on the intermediate transfer body is secondarily transferred to a recording material, in a state where a secondary transfer bias is applied, and a control unit configured to apply a charging bias to the first charging device and apply an AC voltage to the second charging device in a state where a mode of forming a toner image on the third image bearing member arranged downstream, in a rotating direction of the intermediate transfer body, of the first image bearing member, without having toner images formed on the first image bearing member and the second image bearing member, and of secondarily transferring the toner image formed on the third image bearing member to the recording material through the intermediate transfer body in a state where the first through third image bearing members are abutted against the intermediate transfer body is executed.

Further features of the present invention will become apparent from the following description of exemplary embodiments with reference to the attached drawings.

BRIEF DESCRIPTION OF THE DRAWINGS

FIG. 6 is a view illustrating a relationship between temperature and humidity and occurrence of ghost images.

DESCRIPTION OF THE EMBODIMENTS

Figure 1:
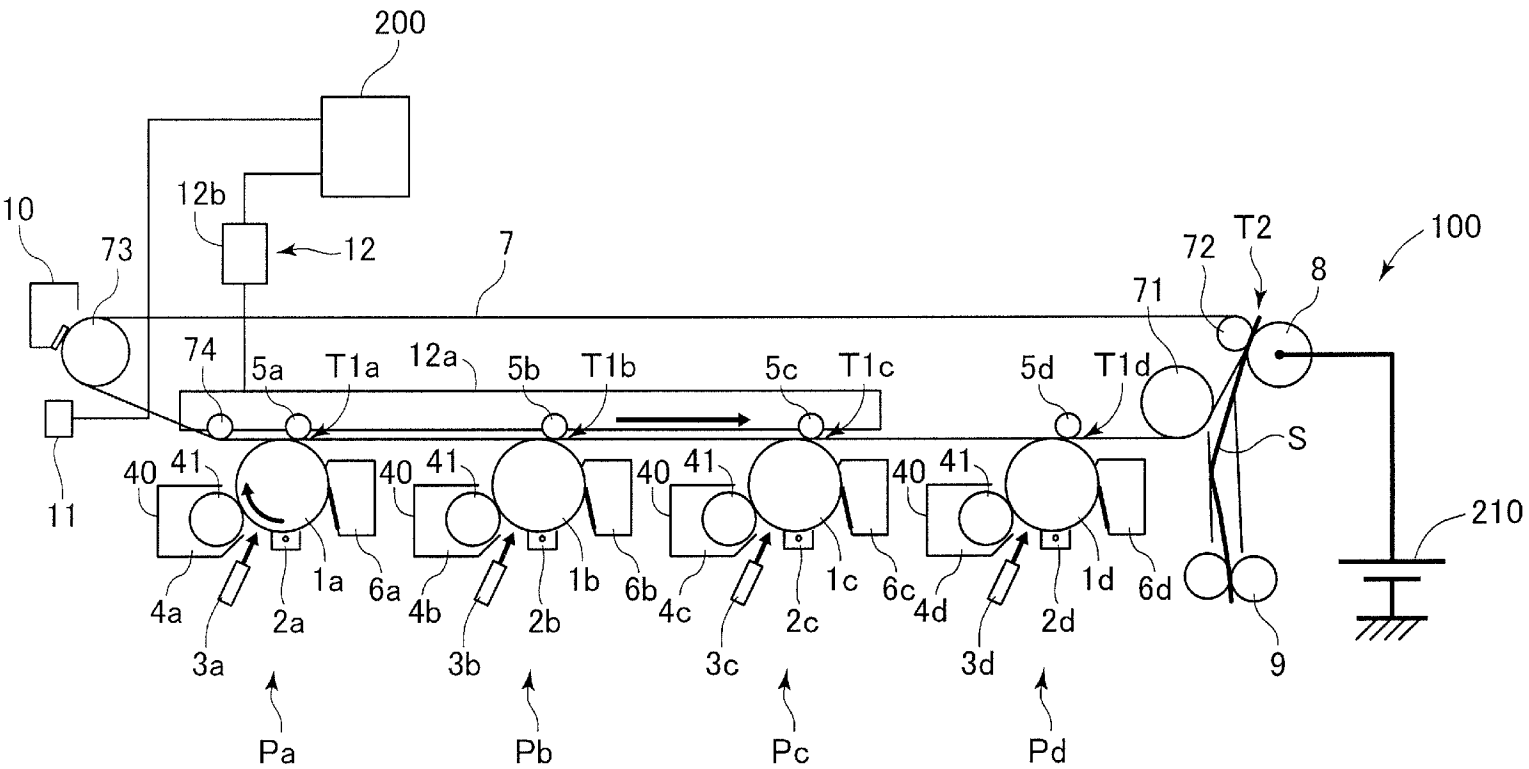
FIG. 1 is a schematic configuration diagram of an image forming apparatus according to a preferred embodiment.

A preferred embodiment will be described with reference to FIGS. 1 through 11. First, a schematic arrangement of an image forming apparatus according to the present embodiment will be described with reference to FIG. 1.

Image Forming Apparatus

An image forming apparatus 100 is a so-called tandem intermediate transfer-type full color printer having four image forming portions Pa, Pb, Pc, and Pd provided to correspond to four colors of yellow, magenta, cyan, and black (Y, M, C, and K). The image forming apparatus 100 forms on a recording material S a toner image, i.e., image, according to an image signal from a document reading apparatus (not shown) connected to a main body of the image forming apparatus or a host device such as a personal computer connected to the image forming apparatus body in a communicatable manner. Examples of the recording material include paper, plastic film, cloth and other sheet materials.

The outline of an image forming process will be described. At first, toner images of respective colors are formed on photosensitive drums, i.e., xerographic photoreceptors, 1*a*, 1*b*, 1*c*, and 1*d*, serving as image bearing members, in the respective image forming portions Pa, Pb, Pc, and Pd. The toner images of respective colors formed as described are transferred to the intermediate transfer belt 7 serving as an intermediate transfer body, and thereafter, transferred from the intermediate transfer belt 7 to the recording material S. The recording material onto which the toner image has been transferred is conveyed to a fixing device (not shown), where the toner image is fixed to the recording material. Now, the process will be described in further detail.

The four image forming portions Pa, Pb, Pc, and Pd provided in the image forming apparatus 100 have approximately the same configuration, except for the difference in the developer colors. Therefore, the image forming portion Pa will be described as a typical example.

A cylindrical photoconductor, that is, a photosensitive drum 1*a*, is arranged as an image bearing member in the image forming portion Pa. The photosensitive drum 1*a* is an organic photoconductor, where a photosensitive layer formed of an organic substance and a surface protection layer are sequentially laminated on a conductive support, and the drum is driven to rotate in a direction of an arrow in the drawing. A charging device 2*a*, a developing unit 4*a*, a primary transfer roller 5*a*, and a drum cleaning device 6*a* are arranged in the circumference of the photosensitive drum 1*a*. An exposing unit 3*a* is arranged below the photosensitive drum 1*a* in the drawing.

Further, the intermediate transfer belt 7 is arranged so that an outer circumferential surface of the belt may abut against the photosensitive drums 1*a*, 1*b*, 1*c*, and 1*d* at a position where the respective image forming portions Pa, Pb, Pc, and Pd face the photosensitive drums 1*a*, 1*b*, 1*c*, and 1*d*. The intermediate transfer belt 7 is stretched on stretch rollers 71 and 74, a secondary transfer inner roller 72, and a drive roller 73, and driven to perform circulating movement, i.e., rotate, in the direction of the arrow in the drawing by the drive of the drive roller 73. A tension of approximately 29 to 118 N (approximately 3 to 12 kgf) is applied on the intermediate transfer belt 7.

A secondary transfer outer roller 8 serving as a secondary transfer member is arranged at a position opposed to the secondary transfer inner roller 72 with the intermediate transfer belt 7 intervened, the outer rollers constituting a secondary transfer portion T2 where a toner image on the intermediate transfer belt 7 is transferred to the recording material S. A fixing device is arranged downstream, in a recording material conveying direction, of the secondary transfer portion T2. The image forming apparatus 100 is controlled by a control unit 200 serving as a controller. That is, as illustrated in FIG. 2, the control unit 200 controls respective components of the image forming apparatus 100, such as the respective image forming portions Pa through Pd.

Figure 2:
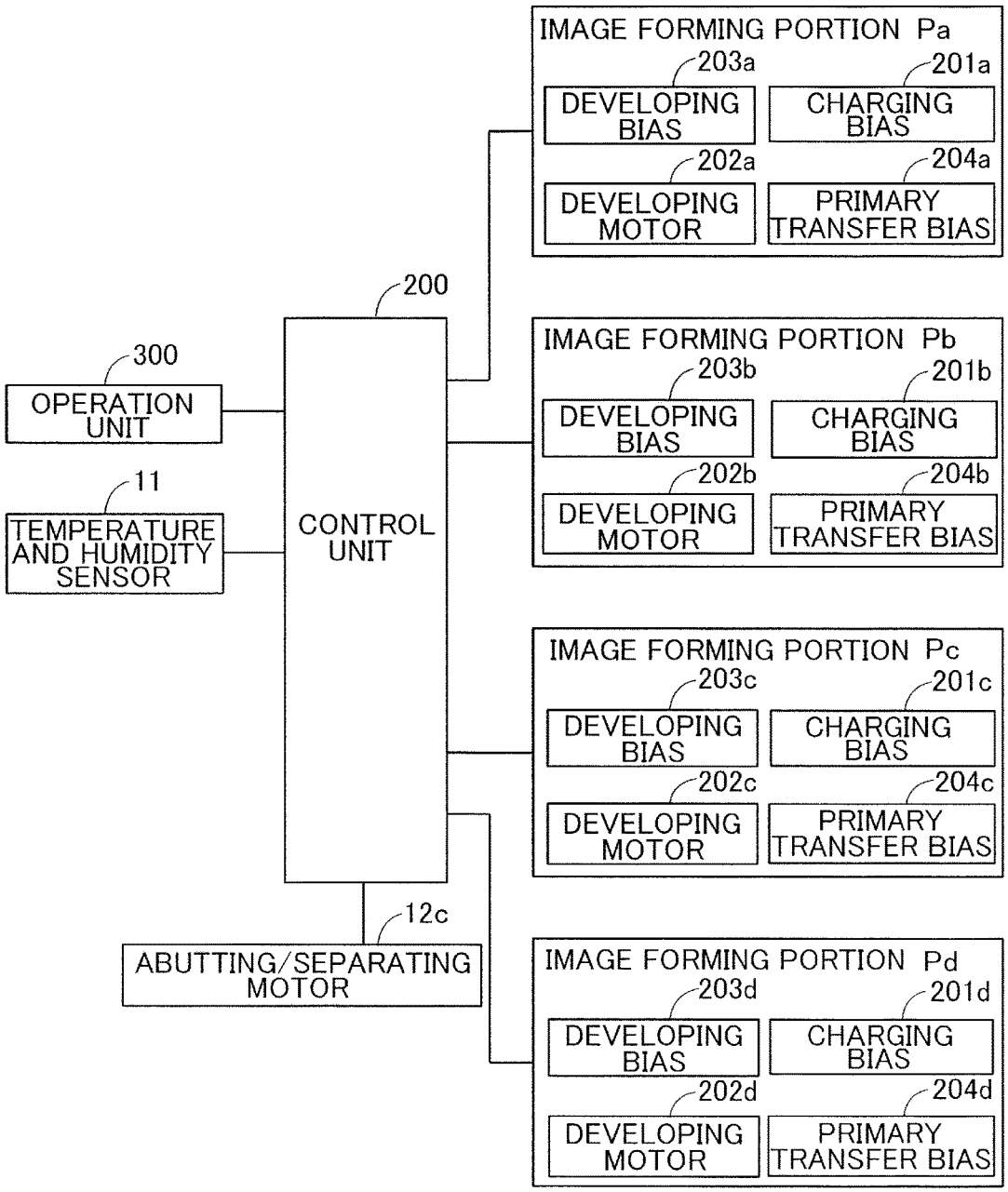
FIG. 2 is a control block diagram of the image forming apparatus according to the preferred embodiment.

FIGS. 1 and 2 are referred to in describing a process for forming a four-color full-color image, for example, by the image forming apparatus 100 having the above-described configuration. At first, in a state where an image forming operation is started, a surface of the rotating photosensitive drum 1*a* is charged to negative polarity uniformly by the charging device 2*a*. At this time, a charging bias having AC voltage superposed to DC voltage is applied to the charging device 2*a* from a charging bias power supply 201*a*. Thereafter, the photosensitive drum 1*a* is exposed by laser beams corresponding to image signals output from the exposing unit 3*a*. Thereby, an electrostatic latent image corresponding to image signals is formed on the photosensitive drum 1*a*, that is, on the first image bearing member.

The electrostatic latent image on the photosensitive drum 1*a* is developed by toner stored in the developing unit 4*a*, and formed as a visible image. The developing unit 4*a* includes a developer container 40 storing a developer including toner, and a developing sleeve 41 as a developer bearing member arranged at a position opposed to the photosensitive drum 1*a*. The developing sleeve 41 being driven to rotate by a developing motor 202*a* serving as a drive source bears the developer within the developer container 40 and conveys the developer to a developing area opposed to the photosensitive drum 1*a*. A developing bias of negative polarity is applied from a developing bias power supply 203*a* to the developing sleeve 41. Thereby, an electrostatic latent image formed on the photosensitive drum 1*a* is developed by toner having negative polarity borne on the developing sleeve 41. In the case of the present embodiment, the developing unit 4*a* uses a two-component developer containing nonmagnetic toner and a magnetic carrier. However, the developing unit can adopt a configuration where a one-component developer is used.

The toner image formed on the photosensitive drum 1*a* is primarily transferred to the intermediate transfer belt 7 at a primary transfer portion T1*a* formed between the drum 1*a* and the primary transfer roller 5*a* arranged on an inner circumferential surface side of the intermediate transfer belt 7. At that time, a primary transfer bias of positive polarity is applied to the primary transfer roller 5*a* from a primary transfer bias power supply 204*a*. Toner remaining on the surface of the photosensitive drum 1*a* after primary transfer, i.e., transfer residual toner, is removed by the drum cleaning device 6*a*.

Such operation is performed sequentially in the respective image forming portions of yellow, magenta, cyan, and black, and the four-color toner images are superposed on the intermediate transfer belt 7, that is, on the intermediate transfer body. In other words, the toner images formed on the respective photosensitive drums 1*a* through 1*d* are superposed on the intermediate transfer belt 7 at the respective primary transfer portions T1*a*, T1*b*, T1*c*, and T1*d*, and a full-color toner image is formed on the intermediate transfer belt 7. Thereafter, at a matched timing of formation of toner images, the recording material S stored in a recording material storage cassette (not shown) is conveyed via a feed roller 9 to the secondary transfer portion T2. Then, by applying a secondary transfer bias from a secondary transfer bias power supply 210 to the secondary transfer outer roller 8, the four-color toner images on the intermediate transfer belt 7 are collectively secondarily transferred to the recording material S. The paper dust and toner not being transferred at the secondary transfer portion T2 and remaining on the intermediate transfer belt 7 are removed by a belt cleaning device 10.

The belt cleaning device 10 is arranged downstream of the secondary transfer portion T2 and upstream of a primary transfer portion T1, i.e., image forming portion Pa, arranged most upstream with respect to the direction of rotation of the intermediate transfer belt 7. At this position, the blade is abutted against the intermediate transfer belt 7 to clean the surface of the intermediate transfer belt 7.

Next, the recording material S is conveyed to a fixing device. The recording material is heated and pressurized by the fixing device, and the toner on the recording material S is melted, mixed, and fixed to the recording material S as a full color image. Thereafter, the recording material S is discharged to an exterior of the apparatus. Thereby, a sequence of the image forming process is ended.

Intermediate Transfer Belt

Figure 3:
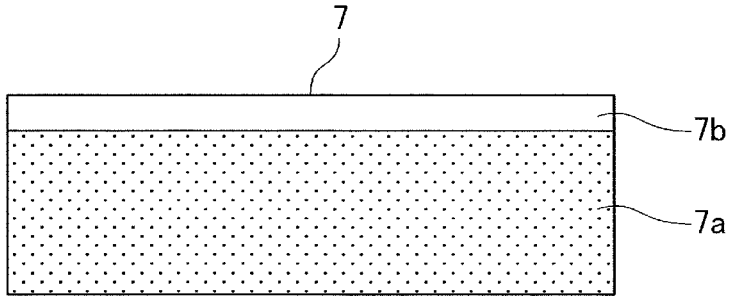
FIG. 3 is a cross-sectional view of an intermediate transfer belt according to the present embodiment.

Next, the intermediate transfer belt 7 serving as an intermediate transfer body will be described in detail with reference to FIG. 3. The intermediate transfer belt 7 is an endless belt composed of a plurality of layers. Specifically, the belt 7 adopts a two-layer configuration composed of a base layer 7*a*, and a surface layer 7*b* formed on a side of the base layer 7*a* bearing the toner image, i.e., outer circumference surface side. Single resin material such as polyimide, polycarbonate, polyvinylidene fluoride (PVDF), polyphenylene sulfide, polyethylene, polypropylene, polystyrene, polyamide, polysulphone, polyarylate, polyethylene terephthalate, polybutylene terephthalate, polyether sulfone, polyether nitrile, ethylene tetrafluoro ethylene copolymer, and polyetheretherketone, or a mixture of such materials, can be used to form the base layer 7*a*.

Material such as a simple substance of melamine resin, urethane resin, alkyd resin, acrylic resin (acrylic monomer, acrylic resin prepolymer, dipentaerythritol hexaneacrylate), silicon-based hard coat, fluorine-based resin, or a mixture of such materials, or a composite material thereof can be used to form the surface layer 7*b*.

In the present embodiment, a polyamide resin, or a polyetheretherketone resin is used for the base layer 7*a*, and a surface layer coat having added fluorine-based resin to acrylic resin is used for the surface layer 7*b*. A thickness of the base layer 7*a* is approximately 60 to 70 μm, and a thickness of the surface layer 7*b* is approximately 5 to 7 μm. A surface resistivity of the intermediate transfer belt 7 after applying the surface coating is $1.0\times10^{12}$ Ω/square or greater and $2.0\times10^{12}$ Ω/square or smaller, and a volume resistivity is $4.0\times10^{11}$ Ω·cm or greater and $6.0\times10^{11}$ Ω·cm or smaller. The measurement of resistance was performed using a measuring instrument of Hiresta UP (Registered Trademark) (product of Mitsubishi Chemical Corporation) and a measuring probe of URS (outer diameter of guard electrode: 17.9 mm) (product of Mitsubishi Chemical Corporation), under a measurement condition in which an applied voltage is set to 100 V and charging for 10 seconds is performed.

Primary Transfer Roller

Next, the configurations of the primary transfer rollers 5*a* through 5*d* will be described in detail. The configurations of the respective primary transfer rollers 5*a* through 5*d* are the same, so that only the primary transfer roller 5*a* will be described below. The primary transfer roller 5*a* is provided on an inner side of the intermediate transfer belt 7 and opposed to the photosensitive drum 1*a*. The primary transfer roller 5*a* is formed of a metal roller formed for example of SUM (sulfur and sulfur composite free-cutting steel) or SUS (stainless steel). A voltage having an opposite polarity as a charging polarity of toner is applied to the primary transfer roller 5*a* from the primary transfer bias power supply 204*a*. Thereby, a primary transfer contrast is formed, which is a potential difference between a surface potential of the photosensitive drum 1*a* and a potential of the primary transfer roller 5*a*. A predetermined primary transfer contrast is formed for each of the primary transfer portions T1*a* through T1*d*, such that the toner images on the respective photosensitive drums 1*a* through 1*d* are sequentially electrostatically attracted onto the intermediate transfer belt 7, and a superposed toner image is formed on the intermediate transfer belt 7. The primary transfer roller 5*a* has a straight shape in the axial direction, with a roller diameter set to approximately 6 to 10 mm.

Secondary Transfer Portion

Next, the secondary transfer portion T2 will be described in detail. The secondary transfer portion T2 is composed of the secondary transfer outer roller 8 arranged on the toner image bearing surface, i.e., outer circumferential surface, side of the intermediate transfer belt 7, and the secondary transfer inner roller 72. The secondary transfer inner roller 72 is formed by providing EPDM (Ethylene-Propylene-Diene rubber) on a periphery of a core metal. The secondary transfer inner roller 72 is formed to have a roller diameter of 20 mm and a rubber thickness of 0.5 mm, with a hardness of 70 degrees (Ascar C), for example. The secondary transfer inner roller 72 is grounded.

On the other hand, the secondary transfer outer roller 8 is formed by providing an elastic layer of NBR (nitrile rubber) or EPDM and the like containing an ion conductive agent such as a metal complex on a periphery of a core metal. The secondary transfer outer roller 8 is formed so that a core metal diameter is set to 12 mm, and a roller diameter including the elastic layer is set to 24 mm. A resistance value of the secondary transfer outer roller 8 is set to 3.0×107 through 5.0×107Ω, and in the secondary transfer portion T2, the resistance value of the secondary transfer inner roller 72 and the intermediate transfer belt 7 is set sufficiently smaller than a resistance value of the secondary transfer outer roller 8.

The secondary transfer bias power supply 210 serving as a high voltage power supply is connected to the secondary transfer outer roller 8, and a secondary transfer bias is applied to the roller. The secondary transfer bias is variable. Specifically, the secondary transfer bias is determined based on an installation environment table, and controlled such that an intended secondary transfer current is supplied to the secondary transfer portion T2. That is, a temperature and humidity sensor 11 serving as a humidity detection unit detecting humidity is provided in an apparatus body of the image forming apparatus 100. The temperature and humidity sensor 11 according to the present embodiment can detect temperature and humidity, and based on the detection result of the temperature and humidity sensor 11, the control unit 200 can detect the temperature and humidity or an absolute moisture content. Further, the control unit 200 determines the secondary transfer bias based on a table, according to the detection result of the temperature and humidity sensor 11. The table has computed in advance the relationship between temperature and humidity and secondary transfer bias, such that the intended secondary transfer current is supplied.

Abutting/Separating Mechanism

Now, the present embodiment is configured to execute a full color mode, or multiple color mode, in which an image forming operation is performed by all image forming portions Pa, Pb, Pc, and Pd, and a single color mode in which the image forming operation is performed only by one image forming portion. In the present embodiment, a monochrome mode can be executed as the single color mode, in which the image forming operation is performed only in the black image forming portion Pd.

Though described in detail later, there is a case where, in the single color mode, photosensitive drums 1*a*, 1*b*, and 1*c*, i.e., first and second image bearing members, of the image forming portions Pa, Pb, and Pc that do not perform image forming operations are separated from the intermediate transfer belt 7. In that case, only a photosensitive drum 1*d*, i.e., third image bearing member, of an image forming portion Pd positioned most downstream in the direction of rotation of the intermediate transfer belt 7 is abutted against the intermediate transfer belt 7 to perform image forming operation. Therefore, as illustrated in FIG. 1, the present embodiment is equipped with an abutting/separating mechanism 12 that abuts or separates the photosensitive drums 1*a*, 1*b*, and 1*c* to or from the intermediate transfer belt 7.

The abutting/separating mechanism 12 includes a support member 12*a* configured to support the primary transfer rollers 5*a*, 5*b*, and 5*c* and the stretch roller 74, and a movement mechanism 12*b* configured to move the support member 12*a*. The movement mechanism 12*b* is equipped with an abutting/separating motor 12*c* (FIG. 2) and a cam configured to be driven by the abutting/separating motor 12*c*, and the support member 12*a* is moved in directions moving toward or away from the photosensitive drums 1*a*, 1*b*, and 1*c* by the cam being driven. In a state where the intermediate transfer belt 7 is separated from the photosensitive drums 1*a*, 1*b*, and 1*c*, the support member 12*a* is moved upward in FIG. 1 by driving the abutting/separating mechanism 12. In this state, the abutting state between the intermediate transfer belt 7 and the photosensitive drum 1*d* is maintained. On the other hand, in a state where the intermediate transfer belt 7 is abutted against the photosensitive drums 1*a*, 1*b*, and 1*c*, the abutting/separating mechanism 12 is driven, such that the support member 12*a* is moved downward in FIG. 1, and the intermediate transfer belt 7 is abutted against all photosensitive drums 1*a* through 1*d*.

The full color mode and the single color mode can be switched by the user selecting the mode, for example, using an operation portion 300 (FIG. 2) provided in the image forming apparatus 100 or a host device connected to the image forming apparatus 100.

Toner Scattering Phenomenon by Residual Electric Charge

As described, the present embodiment uses a resin material in which a conductive agent is added to realize an intended electric resistance value as the intermediate transfer belt 7. Now, there are demands to enable the apparatus to cope with various recording materials. Therefore, in order to realize a uniform and highly-concentrated image even in a state where a paper having a high surface roughness or an uneven paper is used, a surface layer having a superior toner release property is formed on the surface of the intermediate transfer belt with the aim to enhance transfer efficiency during the secondary transfer. A material having added a conductive agent to a resin material having low surface energy, such as fluorinated denatured resin, and having an adjusted resistance value is used as the surface layer material.

In order to enhance the toner release property, it is preferable to reduce the amount of addition of conductive agent on the surface layer, and increase the ratio of the content of fluorinated denatured resin. However, if the amount of the conductive agent is too small, the surface resistance value is increased, such that a surface charge, i.e., residual electric charge, of the intermediate transfer belt will not be attenuated smoothly after the intermediate transfer belt receives transfer charge from the secondary transfer member. Then, at the timing of a subsequent primary transfer, the toner image on the photosensitive drum is affected by the residual electric charge before the photosensitive drum contacts the intermediate transfer belt, and in a state where a portion of the toner image is transferred to the intermediate transfer belt, scattering or deterioration of image quality is caused. Further, in a state where there is unevenness in the residual electric charge on the intermediate transfer belt, uneven scattering is caused, which leads to image unevenness, and image defects, so-called ghosts, occur.

In a state where images are formed continuously to a plurality of recording materials, in a state where the surface charge of the intermediate transfer belt enters the second round without the surface charge sufficiently attenuated, ghosts may appear on the successive recording material. In a state where recording materials are continuously conveyed to the secondary transfer portion, the remaining surface charge may easily occur between the recording material and the subsequent recording material, in other words, between sheets, where the current supplied to the intermediate transfer belt is increased and the amount of charge accumulated on the surface is increased. Further, the remaining surface charge may easily occur at an area where the image area and the non-image area exist in a mixture, were current unevenness easily occurs in a longitudinal direction of the secondary transfer portion. In order to suppress the generation of ghosts caused by the residual electric charge, it is preferable to control the amount of added conductive agent to a value close to the minimum value where scattering is not caused.

On the other hand, charge is not easily attenuated in a state where the resistance of the intermediate transfer belt is high or where electrostatic capacitance of the surface layer is high. One possible method for lowering the electrostatic capacitance is to increase the surface layer thickness. However, as a surface layer forming method, it is popular to coat a coating liquid for forming a surface layer on a base material of the intermediate transfer belt and to perform a hardening process after drying the coating, wherein thicker surface layer coating requires longer time for drying and hardening, and fabrication efficiency is significantly influenced. Therefore, from the viewpoint of fabrication, the thickness of the surface layer is naturally determined, and the maximum thickness is set to approximately 20 μm.

As described, even if the amount of conductive material added to the surface of the intermediate transfer belt or the surface layer thickness are adjusted with the aim to suppress scattering due to the influence of residual electric charge, scattering still occurs, and ghosts caused by the scattering may stand out. As described above, in a state where image forming is performed in a single color mode, ghosts may stand out. Especially in a state where the period of use of the intermediate transfer belt is long, or in a low humidity environment, ghosts tend to occur easily.

For example, in a state where the full color mode is executed in a configuration where a yellow toner image is formed by the photosensitive drum positioned most upstream, ghosts caused by scattering do not stand out by the yellow toner. Since the residual electric charge on the intermediate transfer belt is relieved by applying a primary transfer bias at the primary transfer portion between the yellow photosensitive drum and the intermediate transfer belt, scattering hardly occurs at the primary transfer portion successive to the yellow photosensitive drum.

Figure 4:
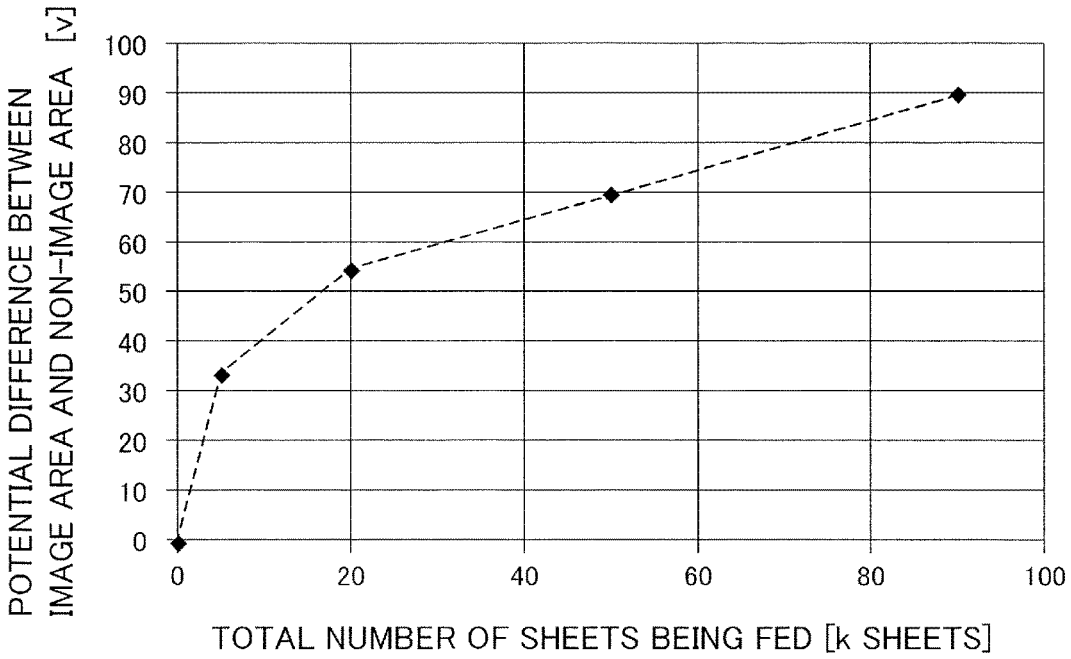
FIG. 4 is a view illustrating a relationship of a potential difference between an image area and a non-image area on an intermediate transfer belt and a total number of sheets being fed.

At first, a case will be described where ghosts tend to occur in a state where the term of use of the intermediate transfer belt is long, in other words, in a state where the total number of sheets of the recording material having passed through the secondary transfer portion, that is, the total number of sheets being fed, is high. FIG. 4 illustrates the relationship between the potential difference between the image area and the non-image area of the intermediate transfer belt and the total number of sheets being fed. This is a result of measurement of the potential difference of the image area and the non-image area of the intermediate transfer belt at a position downstream of the belt cleaning device 10 and upstream of the primary transfer portion T1*a* after performing continuous image forming using the image forming apparatus as illustrated in FIG. 1. The total number of sheets being fed is an integrated number of sheets of paper feed of A3-size paper to the secondary transfer portion from the initial state of the intermediate transfer belt 7. Further, "k sheets" in FIG. 4 refers to the numerical value on the horizontal axis multiplied by 1000 sheets, and for example, 20k sheets corresponds to 20000 sheets. Based on FIG. 4, as the total number of sheets being fed increases, it is recognized that the remaining potential difference of the image area and the non-image are also increased. As a result of executing continuous image forming using the image forming apparatus illustrated in FIG. 1 in a monochrome mode in which only the photosensitive drum 1*d* is abutted against the intermediate transfer belt 7 in a low humidity environment, ghosts started to occur after printing approximately 5000 sheets.

Figure 5:
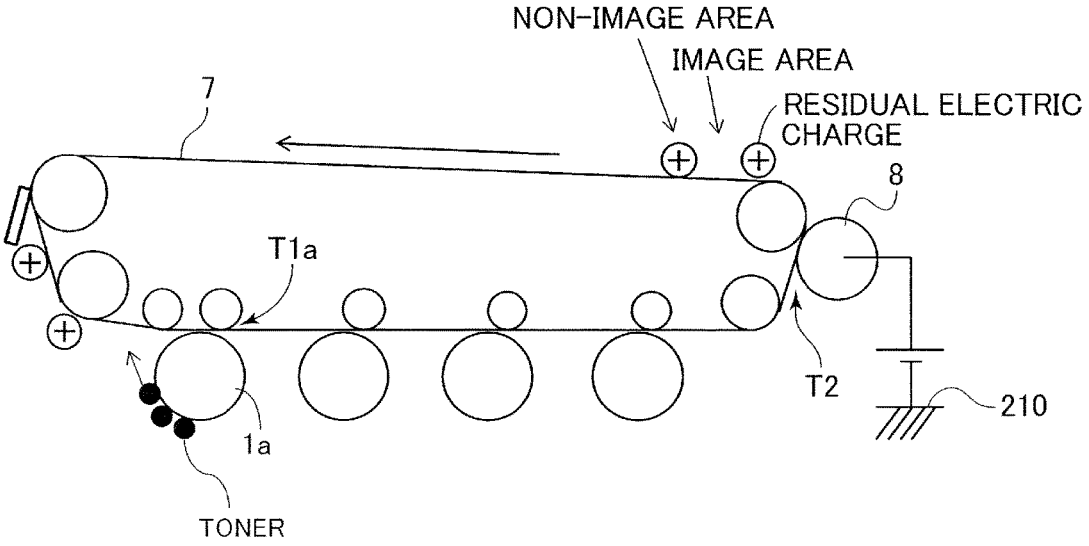
FIG. 5 is an explanatory view of occurrence of ghost images caused by residual electric charge on the intermediate transfer belt.

In an image forming apparatus in a state where ghosts started to occur, after completing the image forming job temporarily, an A3-sized sheet was used to execute a continuous image forming job to five sheets in a monochrome mode in which only the photosensitive drum 1*d* is abutted against the intermediate transfer belt 7. As a result, ghosts started to occur from the third sheet. FIG. 5 is a drawing illustrating a state of surface charge of the intermediate transfer belt 7. FIG. 5 illustrates a state in which scattering occurs in the full color mode, but a similar state occurs in the monochrome mode. In the present embodiment, a voltage having a positive polarity is applied to the secondary transfer outer roller 8 to transfer the toner having negative polarity to the recording material at the secondary transfer portion T2. Therefore, residual electric charge of positive polarity occurs during secondary transfer, as illustrated in FIG. 5.

In a state where image forming is performed continuously, as illustrated in FIG. 5, charge unevenness, i.e., residual electric charge, occurs on the intermediate transfer belt 7 after image is transferred to the first sheet at the secondary transfer portion T2. If the belt enters the primary transfer portion T1*a* in a state where the charge is not attenuated, toner scattering occurs upstream of the primary transfer portion T1*a*, causing image unevenness and leading to occurrence of so-called ghosts.

During primary transfer, the first and second sheets after starting of the image forming job are not superposed with the portion of the intermediate transfer belt 7 that had passed through the secondary transfer portion T2 during application of secondary transfer bias, so that they are not influenced by the charge unevenness on the intermediate transfer belt. Therefore, ghosts appeared from the third sheet. As described, this drawback tends to occur during continuous image forming.

The number of sheets subjected to continuous image forming where ghosts start to appear differs depending on the sheet size. The term image forming job refers to a sequence of operations from the start of the image forming to the completion of the image forming operation based on the print signals for forming images on the recording materials. Specifically, the period is defined as a period from pre-rotation, i.e., preparation operation prior to image forming, after receiving the print signal to post-rotation, i.e., operation after image has been formed, and includes an image forming period and an interval timing between sheets, i.e., during non-image forming operation. Further, a continuous image forming job refers to an image forming job performed based on print signals for forming images continuously on a plurality of recording materials.

Next, we will describe a state where ghosts tend to appear under a low humidity environment. The image forming apparatus illustrated in FIG. 1 was used, wherein a plurality of environmental conditions, regarding temperature and humidity, were set as illustrated in FIG. 6, and the status of occurrence of ghosts has been examined in a state where continuous image forming operations were performed. In the present example, the status of occurrence of ghosts was examined under a normal monochrome mode in which only the photosensitive drum 1*d* is abutted against the intermediate transfer belt 7 in the monochrome mode.

As illustrated in FIG. 6, ghosts occurred in a state where an absolute moisture content computed based on environment temperature and humidity detected by the temperature and humidity sensor 11 was lower than 5 g/m$^3$, and ghosts did not appear in a state where the temperature and humidity were higher. This is considered to be caused by the fact that the adhesion between the intermediate transfer belt and the toner is small under a low humidity environment, and toner charge is increased, such that toner scattering at the area upstream of the primary transfer portion tends to occur. If the ghost countermeasure mode described later is executed, ghosts did not occur under any of the environments, as illustrated in FIG. 6.

Respective Modes

As described, in a normal monochrome mode in which only the photosensitive drum 1*d* is abutted against the intermediate transfer belt 7 under an environment where the total number of sheets being fed is 5000 sheets or greater or where the absolute moisture content is lower than 5 g/m$^3$, ghosts tend to occur. Therefore, according to the present embodiment, as a monochrome mode, a ghost countermeasure mode, i.e., a first mode, can be executed in addition to a normal monochrome mode, i.e., a third mode. Therefore, the image forming apparatus of the present embodiment is capable of executing three modes, including the full color mode, i.e., second mode. At first, the full color mode will be described.

Full Color Mode

As descried, according to a full color mode serving as a second mode, the image forming operation is performed in a state where all the photosensitive drums 1*a*, 1*b*, 1*c*, and 1*d* are abutted against the intermediate transfer belt 7. That is, as described above, toner images of respective colors are formed on the surface of the photosensitive drums 1*a*, 1*b*, 1*c*, and 1*d*. Then, the toner images of the respective colors are primarily transferred in a superposed manner on the intermediate transfer belt 7, such that a full color toner image is formed on the intermediate transfer belt 7. The full color toner image is collectively secondarily transferred to a recording material at the secondary transfer portion T2, and the full color toner image is fixed to the recording material S by the recording material S heated and pressurized by the fixing device. Thereby, the image forming operation of a full color image to a single sheet of recording material S is completed.

Figure 7:
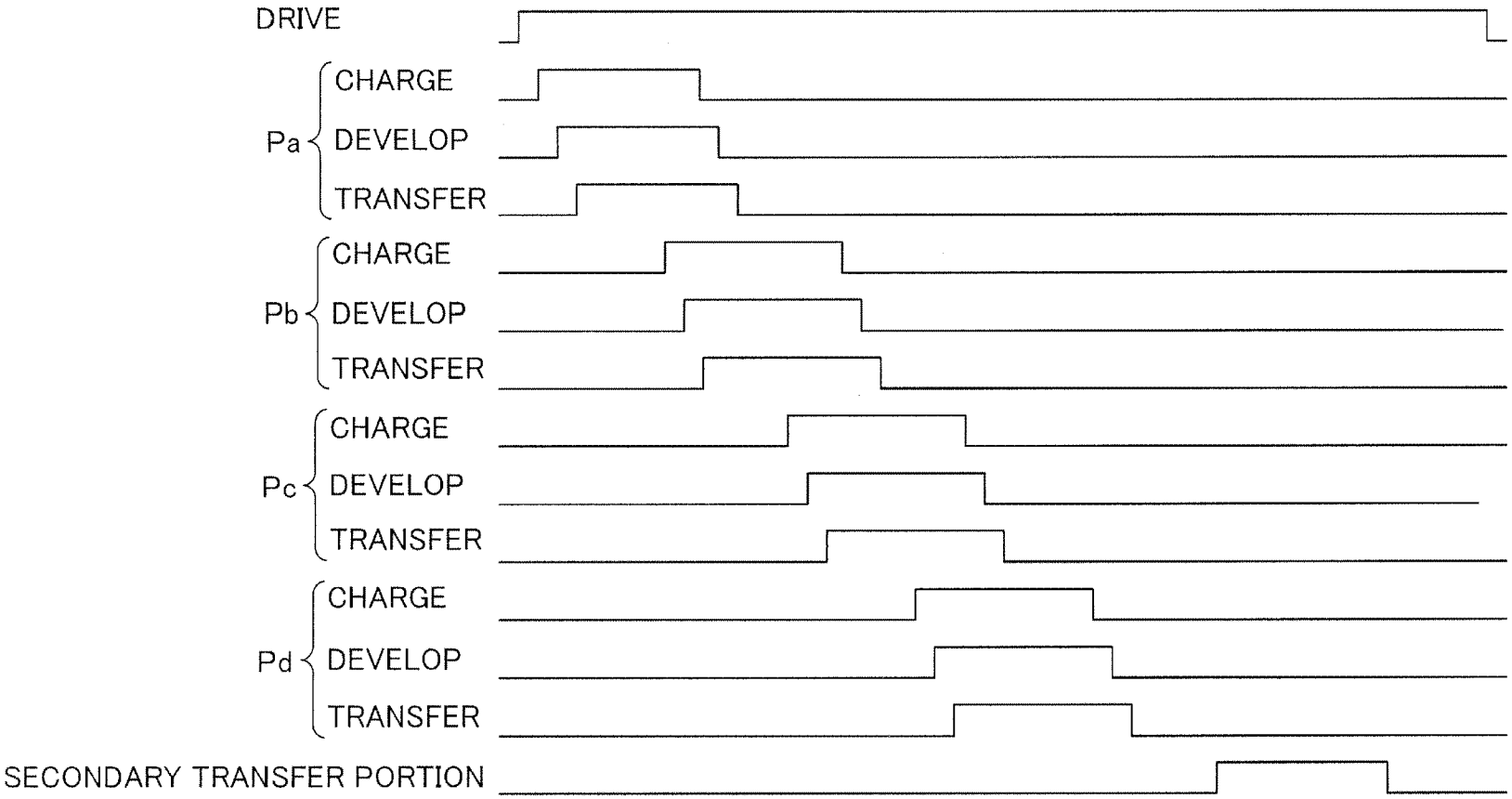
FIG. 7 is a timing chart of raising and lowering of potentials of respective portions in a full color mode according to the present embodiment.

A timing chart during the full color mode of drive of the respective portions and raising and lowering of the potentials of the respective portions, that is, the on and off of high voltage application, is illustrated in FIG. 7. The "drive" of FIG. 7 illustrates the rotational drive of the photosensitive drums 1*a* through 1*d* and the intermediate transfer belt 7, and turning on and off of the drive to convey the recording material. Pa, Pb, Pc, and Pd respectively correspond to the image forming portions Pa, Pb, Pc, and Pd. Further, "charge" refers to the on and off of the charging bias power supply, i.e., charging high voltage, having AC voltage applied to DC voltage, "develop" refers to the on and off of the developing bias power supply, i.e., developing high voltage, and "transfer" refers to the on and off of the primary transfer bias power supply, i.e., transfer high voltage. The term "secondary transfer" refers to the on and off of the secondary transfer bias power supply, i.e., secondary transfer high voltage. The same definition applies to FIGS. 9 and 10.

As illustrated in FIG. 7, in the full color mode, after starting the drive of the photosensitive drum and intermediate transfer belt, application of bias is started, in the named order, to the charging high voltage, the developing high voltage, and the transfer high voltage. Further, the charging high voltage, the developing high voltage, and the transfer high voltage are sequentially raised in the named order at the image forming portions of yellow, magenta, cyan, and black, such that the start positions of the toner images are matched on the intermediate transfer belt 7. Then, in order to transfer the toner image formed on the intermediate transfer belt 7 to the recording material, the secondary transfer high voltage is turned on at the secondary transfer portion. After completing the image forming of the toner image on the final recording material of the image forming job, the high voltages are turned off sequentially, and finally, the drive is turned off.

Normal Monochrome Mode

Next, a normal monochrome mode will be described. The normal monochrome mode, serving as the third mode, is a mode in which a toner image is formed on the photosensitive drum 1*d* without forming toner images on the photosensitive drums 1*a*, 1*b*, and 1*c*, with the photosensitive drums 1*a*, 1*b*, and 1*c* separated from the intermediate transfer belt 7. In other words, the present mode is a mode in which image forming is performed in a state where the photosensitive drums 1*a*, 1*b*, and 1*c*, which are drums that do not perform image forming, in other words, that do not bear toner images among the plurality of photosensitive drums 1*a*, 1*b*, 1*c*, and 1*d*, are separated from the intermediate transfer belt 7.

In the case of a normal monochrome mode, the plurality of primary transfer rollers 5*a*, 5*b*, and 5*c* on the inner circumferential surface side of the intermediate transfer belt 7 are moved away from the intermediate transfer belt 7, according to which the photosensitive drums 1*a*, 1*b*, and 1*c* are separated from the intermediate transfer belt 7. Excluding the one photosensitive drum 1*d*, the other photosensitive drums 1*a*, 1*b*, and 1*c* are positioned at a transfer incapable position with respect to the intermediate transfer belt 7. Therefore, the intermediate transfer belt 7 maintains an abutted state with the single photosensitive drum 1*d* between the stretch rollers 71 and 74.

In the normal monochrome mode, only the image forming portion Pd is operated, and the other image forming portions Pa, Pb, and Pc are stopped. That is, in the image forming portion Pd, similar to the full color mode, the surface of the photosensitive drum 1*d* is charged by the charging device 2*d*, i.e., third charging device, and by the exposing operation of the exposing unit 3*d*, an electrostatic latent image corresponding to the black color is formed on the surface of the photosensitive drum 1*d*. The electrostatic latent image on the photosensitive drum 1*d*, that is, on the third image bearing member, is developed as toner image by the black toner in the developing apparatus 4*d*. Then, the toner image is transferred to the intermediate transfer belt 7 at the primary transfer portion T1*d* serving as the third primary transfer portion.

On the other hand, charging bias is not applied to the charging devices 2*a*, 2*b*, and 2*c*, i.e., first and second charging devices, of the image forming portions Pa, Pb, and Pc, and the exposing units 3*a*, 3*b*, and 3*c* are not operated. Further, developing bias is not applied to the developing units 4*a*, 4*b*, and 4*c*, and the respective developing sleeves 41 are not driven to rotate. Therefore, the timings of driving the respective portions and raising and lowering of potentials of the respective portions during the normal monochrome mode are as follows. That is, in the timing chart of FIG. 7, the period from a state where there is no raising of respective high voltages of Pa, Pb, and Pc, and from when the "drive" is turned on, to a state where the "charge" of "Pd" is turned on, is substantially the same as the period from a state where the "drive" is turned on to a state where the "charge" of "Pa" is turned on.

If the image forming job of the normal monochrome mode is started in a state where the intermediate transfer belt 7 is abutted against the photosensitive drums 1*a* through 1*c*, the time from when the job is started to the start of the drive is delayed corresponding to the time in which the operation to separate the intermediate transfer belt 7 is performed. Similarly, if the image forming job of full color mode or the ghost countermeasure mode is started in a state where the intermediate transfer belt 7 is separated from the photosensitive drums 1*a* through 1*c*, the time from when the job is started to the start of the drive is delayed corresponding to the time required to perform the operation to abut the intermediate transfer belt 7 to the drums.

Ghost Countermeasure Mode

Next, the ghost countermeasure mode will be described. In the ghost countermeasure mode serving as the first mode, the photosensitive drum 1*a* serving as the first image bearing member, the photosensitive drums 1*b* and 1*c* respectively serving as the second image bearing member, and the photosensitive drum 1*d* serving as the third image bearing member are abutted against the intermediate transfer belt 7. In this state, a toner image is formed on the photosensitive drum 1*d* downstream in the direction of rotation of the intermediate transfer belt 7 of the photosensitive drum 1*a*, without forming toner images on the photosensitive drums 1*a*, 1*b*, and 1*c*, and the toner image is secondarily transferred to the recording material S through the intermediate transfer belt 7. In other words, the ghost countermeasure mode is a mode in which a toner image is formed on the photosensitive drum 1*d* without forming toner images on the photosensitive drums 1*a*, 1*b*, and 1*c* in a state where all photosensitive drums 1*a*, 1*b*, and 1*c* are abutted against the intermediate transfer belt 7. The toner image formed on the photosensitive drum 1*d* is transferred to the recording material S through the intermediate transfer belt 7. The operation performed at the image forming portion Pd is the same as during the normal monochrome mode.

Further, during execution of the ghost countermeasure mode, the control unit 200 at least controls the charging device 2*a* as the first charging device, such that the primary transfer contrast at the primary transfer portion T1*a* of yellow toner, serving as the first primary transfer portion, is set equal to or greater than the discharge starting voltage. At the same time, the control unit 200 applies AC voltage to the charging devices 2*b* and 2*c* serving as second charging devices. The AC voltage applied to the charging devices 2*b* and 2*c* are set so that a discharge current having a smaller current quantity than the full color mode is supplied. In the present embodiment, DC voltage is not applied to the charging devices 2*b* and 2*c*, and only AC voltage, i.e., charging AC bias, is applied. Further, primary transfer bias is not applied to the primary transfer portions T1*b* and T1*c* of magenta and cyan serving as the secondary primary transfer portions.

Further, the control unit 200 applies primary transfer bias to the primary transfer portion T1*a* in a state where the ghost countermeasure mode is executed. The primary transfer contrast at the primary transfer portion T1*a* during the ghost countermeasure mode is set equal to the state where the full color mode is executed. Therefore, the control unit 200 stops the rotation of the developing sleeve 41 and applies developing bias in a state where the ghost countermeasure mode is executed.

That is, in the ghost countermeasure mode, application of bias to the respective portions is performed similar to the full color mode, except that the drive of the developing sleeve 41 and the forming of electrostatic latent image is not performed at the image forming portion P1 most upstream in the direction of rotation of the intermediate transfer belt 7. Thereby, a primary transfer contrast equal to performing the full color mode is formed at the primary transfer portion T1*a*, such that the residual electric charge accompanying application of secondary transfer bias at the secondary transfer portion T2 is relieved.

Now, in the ghost countermeasure mode, a charging bias, that is, bias having AC voltage superposed to DC voltage, equivalent to the full color mode is applied to the photosensitive drum 1*a* of the image forming portion Pa, such that a bias equivalent to the full color mode is also applied as the developing bias. The reason for this is because if developing bias is not applied, the carrier will adhere to the surface of the charged photosensitive drum 1*a*. Further, since developing bias is applied, a large amount of toner may be adhered to the surface of the photosensitive drum 1*a* in a state where the developing sleeve 41 is driven to rotate, and the drive of the developing sleeve 41 is stopped.

In the ghost countermeasure mode, it is merely necessary to form a primary transfer contrast capable of relieving residual electric charge accompanying the application of the secondary transfer bias to the primary transfer portion T1*a*. Therefore, the photosensitive drum 1*a* is charged at least by applying charging bias, to merely form a primary transfer contrast equal to or greater than the discharge starting voltage to the primary transfer portion T1*a*. It is also possible to lower the absolute value of the potentials of the respective portions such that such primary transfer contrast is formed.

For example, it is possible to apply only a charging bias in which DC voltage smaller than during the full color mode is superposed to AC voltage, and to not have the primary transfer bias applied. It is also considerable to apply only the primary transfer bias and not apply the charging bias. However, in that case, charging unevenness may occur to the photosensitive drum 1*a*, such that it is preferable to apply at least the charging bias. As for the developing bias, it is either preferable to lower the absolute value to a level such that carrier adhesion is not caused, or to not have the bias applied, according to the level of absolute value of the charging bias.

On the other hand, in the image forming portions Pb and Pc other than the image forming portion Pa positioned most upstream and the image forming portion Pd in which the image is formed, there is no need to form the primary transfer contrast at the primary transfer portions T1*b* and T1*c*, as described. Incidentally, it is also possible to form a primary transfer contrast similar to the primary transfer portion T1*a* at either the primary transfer portions T1*b* or T1*c*. However, the life of the photosensitive drums 1*b* and 1*c* are deteriorated by applying voltage, such that it is preferable not to form such primary transfer contrast at the primary transfer portions T1*b* and T1*c*.

However, the photosensitive drums 1*b* and 1*c* of the image forming portions Pb and Pc, i.e., image bearing members other than the first and third image bearing members, are abutted against the intermediate transfer belt 7, so the drums are driven to rotate to suppress friction with the intermediate transfer belt 7. Therefore, the surfaces of photosensitive drums 1*b* and 1*c* may not be converged to 0 V due to the influence of the primary transfer contrast formed at the image forming portion Pa or the influence of friction of the cleaning blades of the drum cleaning devices 6*b* and 6*c*. If the surfaces of the photosensitive drums 1*b* and 1*c* are not converged to 0 V, charging unevenness may occur at the photosensitive drums 1*b* and 1*c* during image forming performed thereafter. Therefore, according to the present embodiment, only AC voltage is applied to the charging devices 2*b* and 2*c* and a discharge current smaller than the full color mode is supplied to the photosensitive drums 1*b* and 1*c*, such that the surfaces of the photosensitive drums 1*b* and 1*c* are converted to 0 V.

Figure 8:
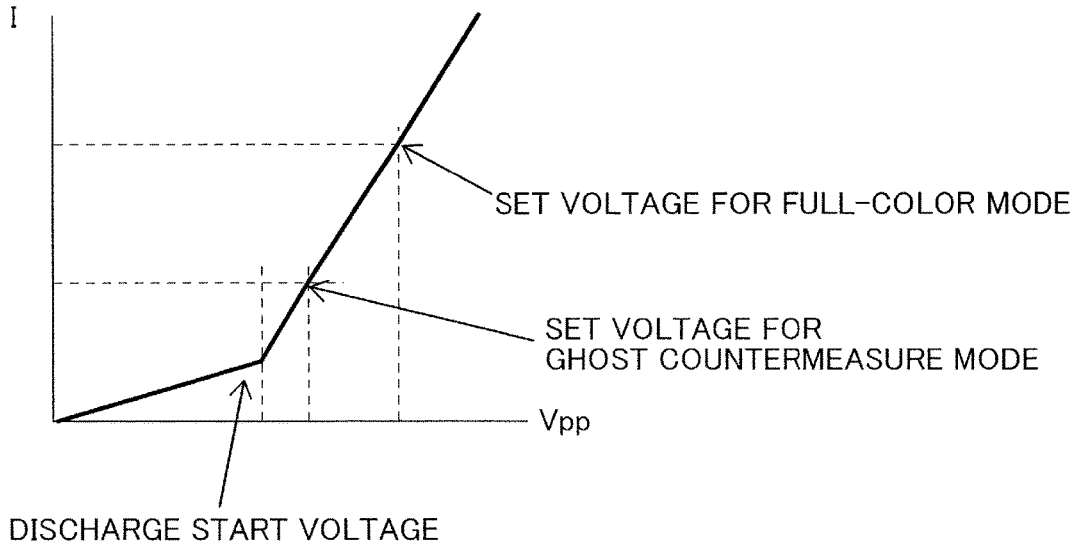
FIG. 8 is a view illustrating a relationship between a charging AC bias (Vpp) and a current quantity (I).

The setting of the AC voltage, i.e., AC bias, of the charging bias power supplies 201*b* and 201*c* applying voltage to charging devices 2*b* and 2*c* is a peak-to-peak voltage (Vpp) and frequency set so that a discharge current I becomes greater than 0 μA. Specifically, the Vpp is set greater than the discharge starting voltage and smaller than the set voltage during the full color mode, as illustrated in FIG. 8. In the present embodiment, the Vpp is set such that the discharge current during the full color mode is 50 μA, and the discharge current during the ghost countermeasure mode is 5 μA. Further, the frequency of the AC voltage is set to the same value for the full color mode and for the ghost countermeasure mode.

In a state where the ghost countermeasure mode is executed, a charging AC bias in which the discharge current is greater than 0 μA is continuously applied, such that the surface potential of the photosensitive drums 1*b* and 1*c* is converged to 0 V. Even if the mode is switched to the full color mode in the subsequent image forming operation, a uniform image density can be ensured.

In the ghost countermeasure mode of the present embodiment, no developing bias is applied to the developing apparatuses 4*b* and 4*c*, and no primary transfer bias is applied to the primary transfer rollers 5*b* and 5*c*. Further, the driving of the developing sleeves 41 of the developing apparatuses 4*b* and 4*c* are stopped. In other words, the photosensitive drums 1*b* and 1*c* are driven in the image forming portions Pb and Pc, and only AC voltage is applied from the charging bias power supplies 201*b* and 201*c*.

It is also possible to apply to the primary transfer rollers 5*b* and 5*c* a primary transfer bias enabling to supply a transfer current smaller than during the full color mode to the primary transfer portions T1*b* and T1*c*. Further, a DC voltage smaller than the voltage applied during the full color mode can be applied by superposing to the AC voltage described above to the charging devices 2*b* and 2*c* as charging bias. In this case, a developing bias smaller than that during the full color mode may be applied to the developing apparatuses 4*b* and 4*c* to prevent carrier adhesion. The reason for setting the bias being applied to the respective portions to be smaller than that applied during the full color mode is to suppress deterioration caused by conducting. In other words, it is preferable to set the biases to be applied to the respective portions such that charging unevenness and carrier adhesion on the photosensitive drums 1*b* and 1*c* are suppressed, and such that deterioration of power supply to the respective members is suppressed.

In a state where such continuous image forming job of the ghost countermeasure mode is executed, the control unit 200 forms the above-described primary transfer contrast to the primary transfer portion T1*a* at the following timing. That is, at a timing in which the portion of the intermediate transfer belt 7 having passed through the secondary transfer portion T2 to which the secondary transfer bias has been applied at the start of the continuous image forming job reaches the primary transfer portion T1*a*, the primary transfer contrast set equal to or greater than the discharge starting voltage is formed to the primary transfer portion T1*a*.

Figure 9:
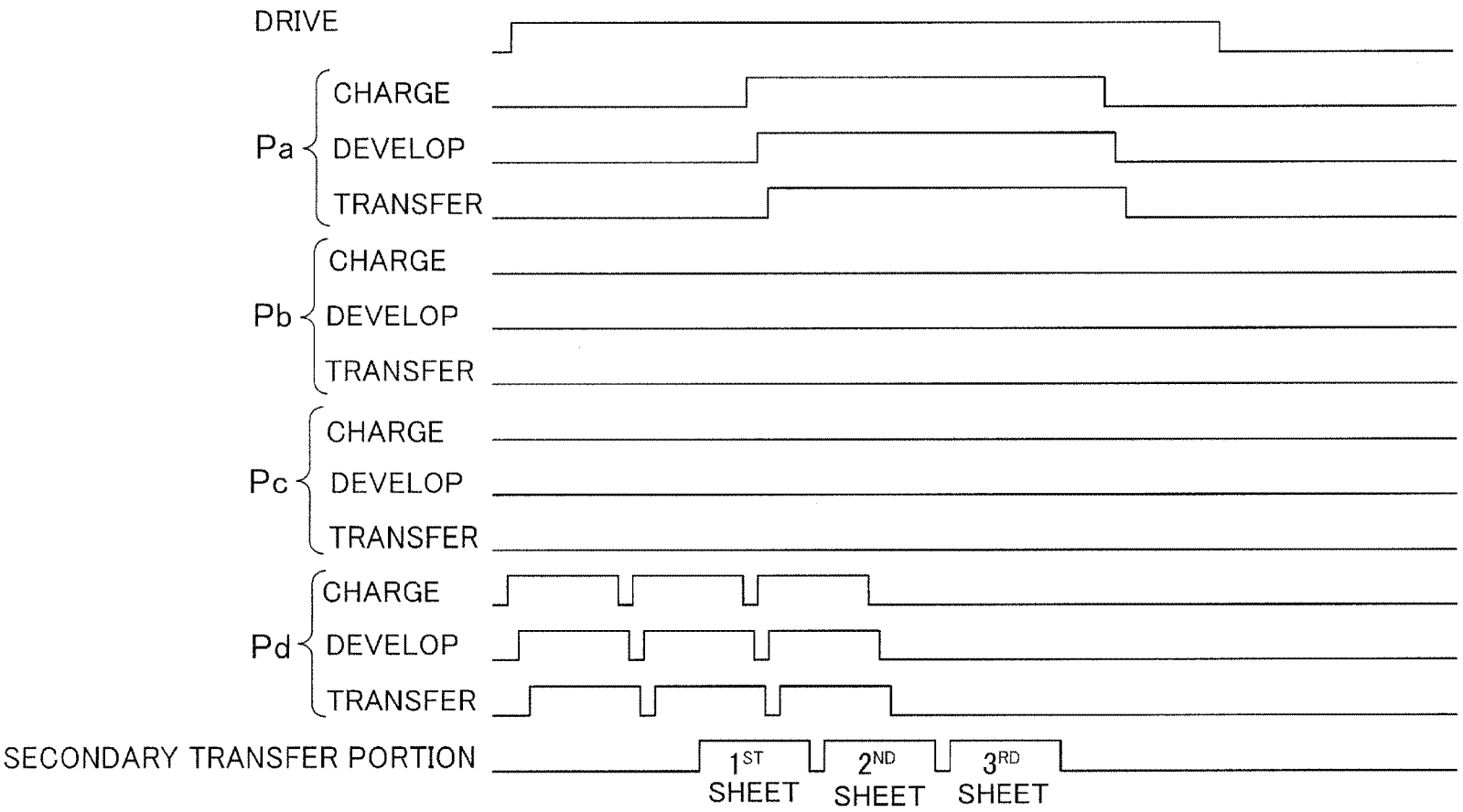
FIG. 9 is a timing chart of raising and lowering of potentials of respective portions during a ghost countermeasure mode according to the present embodiment.

A case in which a continuous image forming job to three sheets is executed in the ghost countermeasure mode will be described with reference to FIG. 9. The meaning of the respective portions of FIG. 9 is the same as FIG. 7 described earlier. In the ghost countermeasure mode, image forming is started from a same leading edge position of the image as the normal monochrome mode, while having the primary transfer rollers 5*a* through 5*d* of all image forming portions contact the intermediate transfer belt 7. After the photosensitive drums 1*a* through 1*d* and the intermediate transfer belt 7 are started to be driven, application of bias is started in the named order from charging high voltage, developing high voltage, and transfer high voltage of the image forming portion Pd, and thereafter, the application of a secondary transfer high voltage is started.

The primary transfer contrast described above is formed to the primary transfer portion T1*a* immediately before the portion of the intermediate transfer belt 7 having passed the secondary transfer portion T2 during application of the secondary transfer bias enters the primary transfer portion T1*a* of the image forming portion Pa. That is, the charging high voltage, the developing high voltage, and the primary transfer high voltage of the image forming portion Pa is raised in the named order before the portion of the belt 7 enters the primary transfer portion T1*a*, such that at a timing or immediately before the leading edge of the above-described portion reaches the primary transfer portion T1*a*, the above-described primary transfer contrast is formed.

Although not illustrated in FIG. 9, the charging AC bias of the image forming portions Pb and Pc should preferably be raised speedily after driving the photosensitive drum and the intermediate transfer belt. For example, the charging AC bias of the image forming portions Pb and Pc are raised at the same timing as the raising of the charging high voltage of the image forming portion Pd. In another example, the charging high voltage of Pa, the charging AC bias of Pb, and the charging AC bias of Pc should be raised sequentially from the upstream side, similar to the raising timing of charging high voltages of Pa, Pb, and Pc during the full color mode (FIG. 7).

By controlling the raising of voltage of the respective portions, the above-described primary transfer contrast is formed at a timing in which the portion of the intermediate transfer belt 7 to which the first image has been transferred at the secondary transfer portion T2 reaches the primary transfer portion T1*a* of the image forming portion Pa, and the above-described primary transfer contrast is formed.

Thereby, the residual electric charge of this portion is relieved by the primary transfer contrast of the primary transfer portion T1*a*. According to the image forming apparatus of the present embodiment, as described above, ghosts start to occur from the third image from the starting of the image forming job. However, as illustrated in FIG. 9, in a state where the third toner image is transferred at the primary transfer portion T1*d* of the image forming portion Pd, the residual electric charge on the intermediate transfer belt 7 is relieved at the primary transfer portion T1*a* of the image forming portion Pa. Therefore, the occurrence of ghosts can be suppressed. Further, since charging AC bias is applied to the photosensitive drums 1*b* and 1*c* in the image forming portions Pb and Pc, it is possible to suppress charging unevenness from occurring to the photosensitive drums 1*b* and 1*c* by the execution of the ghost countermeasure mode.

Thereafter, in a state where the final image forming of the image forming job is completed, the charging high voltage, the developing high voltage, and the primary transfer high voltage are sequentially lowered in the image forming portion Pd. Further, at a timing where the portion of the intermediate transfer belt 7 where secondary transfer of toner image to the final, or third, recording material S has been completed passes the primary transfer portions T1*a*, T1*b* and T1*c*, the voltages of the respective portions are sequentially lowered. That is, the charging high voltage, the developing high voltage, and the primary transfer high voltage of the image forming portion Pa are lowered in the named order, such that the above-described primary transfer contrast is lowered after the above-described portion has passed the primary transfer portion T1*a*. The lowering of the charging AC bias of the image forming portions Pb and Pc is performed at a timing where the position in which the charging AC bias on the photosensitive drums 1*b* and 1*c* has been lowered respectively passes the primary transfer portions T1*b* and T1*c* after the above-described portion has passed the primary transfer portions T1*b* and T1*c*. The above-described portion is a rear edge of the portion of the intermediate transfer belt 7 to which the third image has been transferred at the secondary transfer portion T2. Thereafter, the driving of the photosensitive drum and the intermediate transfer belt 7 is stopped, and the image forming job is ended.

Figure 10:
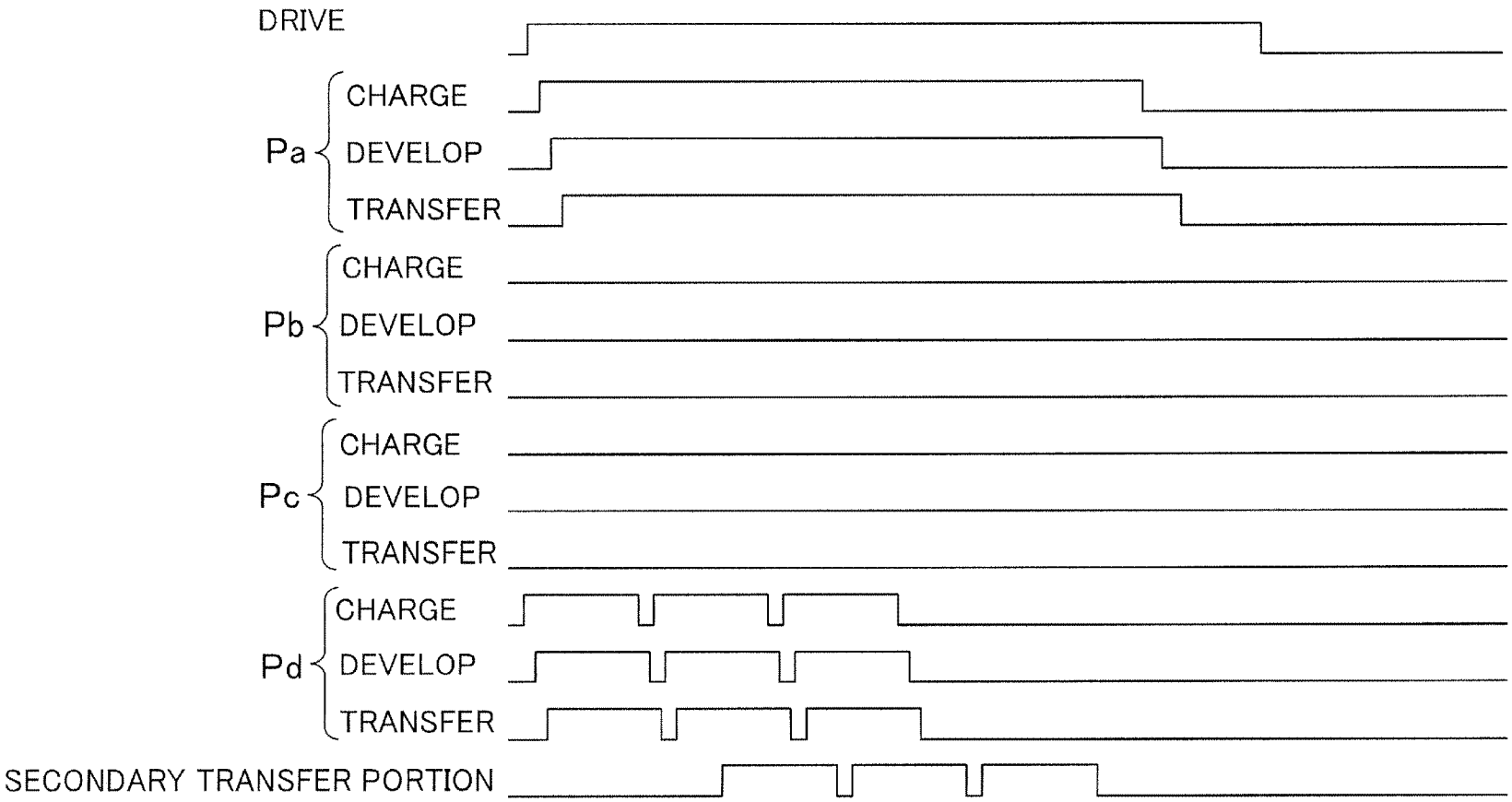
FIG. 10 is a timing chart of raising and lowering of potentials of respective portions during a ghost countermeasure mode according to another example of embodiment.
Figure 11:
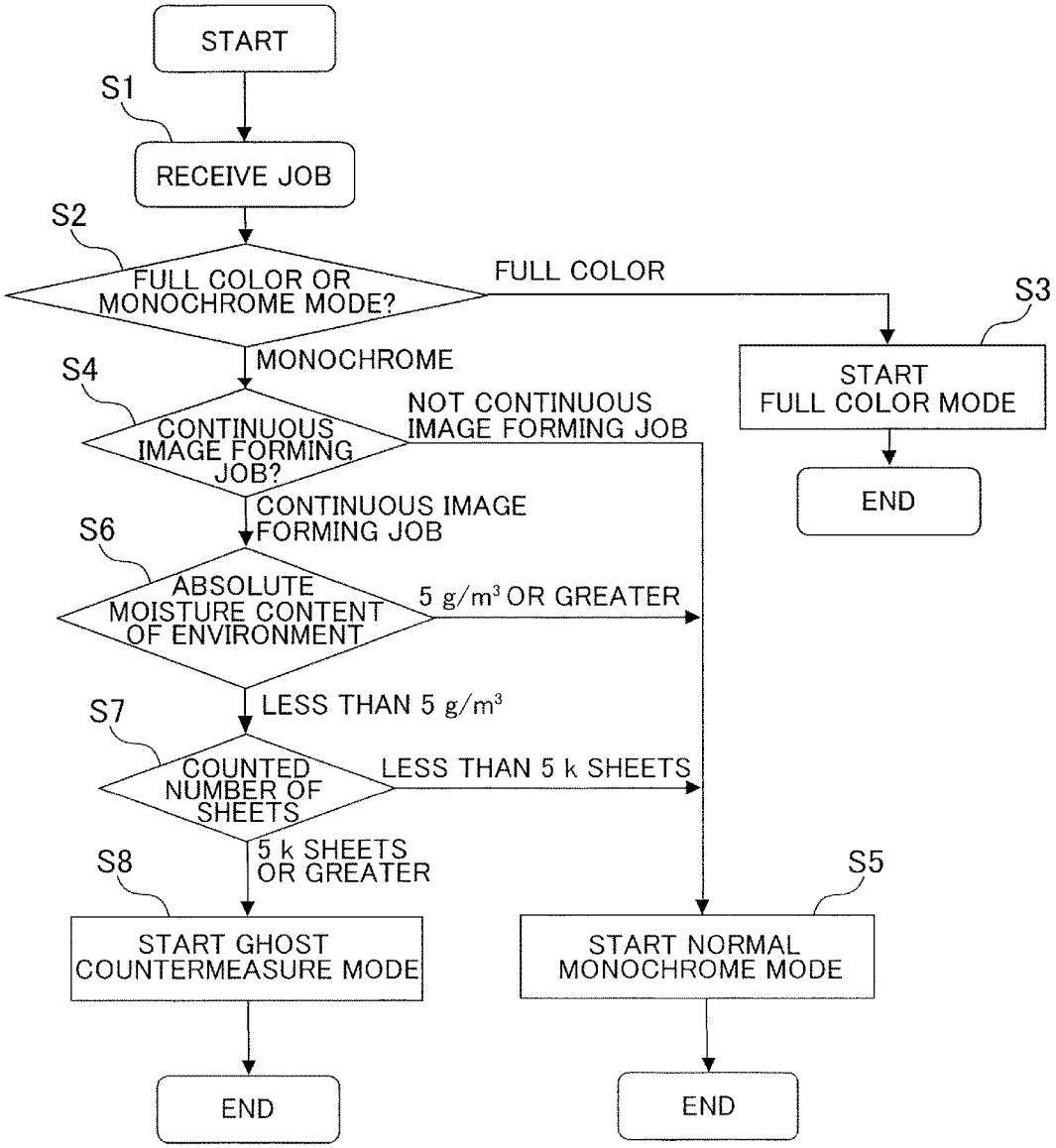
FIG. 11 is a control flow of switching modes according to the present embodiment.

The raising of the charging high voltage, the developing high voltage, and the primary transfer high voltage in the image forming portion Pa may be set to be raised speedily after driving the photosensitive drum and the intermediate transfer belt, as illustrated in FIG. 10. For example, the raising of the charging high voltage of the image forming portion Pa can be performed at the same timing as the raising of the charging high voltage of the image forming portion Pd, and thereafter, the developing high voltage and the primary transfer high voltage can be raised sequentially. Further, the timing can be set to a similar timing as the full color mode. That is, the voltage to be raised in the respective image forming portions Pa through Pd can be raised at a similar timing as the full color mode, sequentially from the upstream image forming portion Pa. However, in order to suppress deterioration of life of the respective members by having high voltage applied, the timing should preferably be performed at a timing illustrated in FIG. 9 described above.

Further, since the primary transfer contrast of the image forming portion Pa for relieving uneven residual electric charge on the intermediate transfer belt differs depending on the intermediate transfer belt, it should preferably be changed appropriately with respect to the belt being used. Further, the charged potential of the photosensitive drum 1*a* in the ghost countermeasure mode should preferably be set to a small absolute value within the range in which ghosts do not appear, from the viewpoint of life of the photosensitive drum. Further, during the time from starting of the image forming job to the entrance of the portion of the intermediate transfer belt having passed the secondary transfer portion T2 during application of secondary transfer bias to the primary transfer portion T1*a*, similarly, the absolute value of the charged potential of the photosensitive drum 1*a* should preferably be set small.

Switching of Modes

Next, an example of a control flow for switching modes as described above will be described based on FIG. 11 with reference to FIG. 2. At first, in a state where the control unit 200 receives a command signal of an image forming job (S1), the control unit 200 determines whether the image forming mode is a monochrome mode or a full color mode (S2). If the mode is a full color mode, the control unit 200 executes the full color mode (S3). If the determined mode is a monochrome mode in S2, the control unit 200 determines whether the image forming job is a continuous image forming job (S4). If it is not a continuous image forming job, that is, if it is a job in which image is formed on a single sheet, ghosts rarely occur as described earlier, so a normal monochrome mode is executed (S5).

Next, in S4, if it is determined to be a continuous image forming job, the control unit 200 determines whether the absolute moisture content of the environment is equal to or greater than a predetermined value based on the detection result of the temperature and humidity sensor 11 (S6). As described in FIG. 6, in the normal monochrome mode, ghosts occur if the absolute moisture content is lower than 5 g/m$^3$, and ghosts do not occur if the content is higher, so that the specified value is set to 5 g/m$^3$. In a state where the absolute moisture content of the environment is equal to or greater than the specified value, ghosts are not likely to occur as described in FIG. 6, so the normal monochrome mode is executed (S5).

Next, in a state where the absolute moisture content of the environment is less than the specified value in S6, the control unit 200 counts the total number of sheets, i.e., counted number of sheets, of the recording material having passed the secondary transfer portion T2, and determines whether the counted number of sheets is equal to or greater than a specified number of sheets (S7). As described in FIG. 4, ghosts start to occur if the number of sheets is equal to or greater than 5k (5000) sheets of A3 size, so the specified number of sheets is set to 5k sheets of A3 size. In a state where the counted number of sheets is less than the specified number of sheets, ghosts rarely occur as described in FIG. 4, so the normal monochrome mode is executed (S5).

Next, in a state where the counted number of sheets in S7 is equal to or greater than the specified number of sheets, the control unit 200 executes the ghost countermeasure mode. That is, in the flow of FIG. 11, it is determined that ghosts tend to occur, and the ghost countermeasure mode is executed in a state where the mode is a monochrome mode and a continuous image forming mode, the absolute moisture content is smaller than the specified value, and the counted number of sheets is equal to or greater than the specified number of sheets.

However, in a state where the job is a continuous image forming job performed to two or more sheets in the monochrome mode, or the job is a continuous image forming job performed to three or more sheets, the ghost countermeasure mode can be executed regardless of the environment or the counted number of sheets. Further, in a state where the absolute moisture content is less than the specified value in the monochrome mode, the ghost countermeasure mode can be executed regardless of whether the job is a continuous image forming job or of the counted number of sheets. Furthermore, in a state where the counted number of sheets is equal to or greater than the specified number of sheets in the monochrome mode, the ghost countermeasure mode can be executed regardless of the environment or whether the job is a continuous image forming job. That is to say, the ghost countermeasure mode can be executed if any one or more than one condition(s) among the continuous image forming mode, the environment, and the counted number of sheets is/are satisfied.

The occurrence of ghosts had been confirmed under the above-described environment regarding the intermediate transfer belt 7 used in the present embodiment, but the environment or the counted number of sheets in which ghosts occur depend on the charge attenuation speed of the belt being used. Therefore, the specified number of sheets of the counted number of sheets or the specified value of the environment should preferably be changed appropriately according to the belt being used.

Further, regardless of the description above, it is possible to enable the user to select the ghost countermeasure mode through use of an operation portion 300 and the like. For example, if the user selects the ghost countermeasure mode, the ghost countermeasure mode is executed even in an image forming job performed on a single sheet, and the ghost countermeasure mode is executed to the first sheet of the counted number of sheets.

The image forming apparatus 100 of the present embodiment configured as above is used to execute a continuous image forming job to five sheets of A3 paper having a grammage of 209 g/m$^2$ and under a low humidity environment (in a state where the set temperature is 23° C. and a set relative humidity is 5%) according to the ghost countermeasure mode described above. As a result, it has been confirmed that no ghosts occurred.

As described, the generation of ghosts by toner scattering caused by the remaining surface charge on the intermediate transfer belt can be suppressed by executing the ghost countermeasure mode under a condition in which ghosts tend to occur. In the ghost countermeasure mode, AC voltage is applied to the charging devices 2*b* and 2*c* such that a discharge current of a smaller current quantity than in the case of the full color mode in the image forming portions Pb and Pc that do not form the toner image is suppressed. Therefore, charging unevenness of the photosensitive drums 1*b* and 1*c* can be suppressed.

Further, even in the monochrome mode, in a state where ghosts rarely occur, the normal monochrome mode is executed, such that deterioration of life by applying voltage to the image forming portions Pa, Pb, and Pc that do not form toner images can be suppressed.

Other Embodiments

In the above-described embodiment, a configuration having the abutting/separating mechanism 12 had been described. However, the present invention is applicable to a configuration without the abutting/separating mechanism 12, that is, a configuration in which the photosensitive drums 1*a*, 1*b*, and 1*c* are not separated from the intermediate transfer belt 7 even in the monochrome mode.

According to the above description, a primary transfer contrast as described above has been formed in the image forming portion Pa arranged most upstream in the ghost countermeasure mode, but the primary transfer contrast can also be formed in the image forming portions Pb and Pc. In that case, AC voltage can be applied to the charging device 2*a* such that a discharge current of a current quantity smaller than in the case of the full color mode is supplied, without applying the primary transfer bias in the image forming portion Pa.

Further, in a state where the image forming portion forming the toner image is not the image forming portion arranged most downstream, but is the second or the third image forming portion counted from the upstream side, the primary transfer contrast as described above is formed at the image forming portion upstream thereof. In the other image forming portions, AC voltage is applied to the charging device such that a discharge current having a smaller current quantity than in the case of the full color mode is supplied, without applying the primary transfer bias.

Further, the above-described primary transfer contrast formed to the primary transfer portion of the image forming portion Pa can be changed according to the counted number of sheets or the environment. For example, in a state where there are a small counted number of sheets, a small primary transfer contrast can be set, and as the counted number of sheets increases, the primary transfer contrast can be increased. Incidentally, in a state where the absolute moisture content of the environment is high, a small primary transfer contrast can be set, and in a state where the absolute moisture content is low, the primary transfer contrast can be increased. However, in any case, a maximum value of primary transfer contrast is set to the primary transfer contrast during the full color mode.

As for the intermediate transfer body, a single layer intermediate transfer belt can be adopted, but since residual electric charge as described above tends to occur in an intermediate transfer belt composed of multiple layers, the present invention is preferably applied to an intermediate transfer belt composed of multiple layers. Further, the present invention can also be preferably applied to an elastic belt containing an elastic layer in midway as the intermediate transfer belt composed of multiple layers.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086481, filed Apr. 22, 2016, which is hereby incorporated by reference herein in its entirety.

What is claimed is:

1. An image forming apparatus comprising:

first through third image bearing members respectively configured to bear toner images and rotate;

first through third charging devices configured to respectively charge surfaces of the first through third image bearing members in a state where a charging bias having AC voltage superposed on DC voltage is applied;

a rotatable intermediate transfer body configured to abut against the first through third image bearing members to form first through third primary transfer portions where toner images formed on the first through third image bearing members are respectively primarily transferred, in a state where a primary transfer bias is applied;

a secondary transfer member configured to form a secondary transfer portion where the toner images formed on the intermediate transfer body are secondarily transferred to a recording material, in a state where a secondary transfer bias is applied; and a control unit configured to execute a first mode of forming a toner image on the third image bearing member, arranged downstream of the first image bearing member in a rotating direction of the intermediate transfer body, without having toner images formed on the first image bearing member and the second image bearing member, and of secondarily transferring the toner image formed on the third image bearing member to the recording material from the intermediate transfer body in a state where the first through third image bearing members are abutted against the intermediate transfer body, and a second mode of forming toner images on the first through third image bearing members, of primarily transferring the toner images onto the intermediate transfer body so as to be superposed upon each other, and of secondarily transferring the superposed toner images on the intermediate transfer body to the recording material, wherein, in a state where the first mode is executed, the control unit controls at least the first charging device such that a primary transfer contrast in the first primary transfer portion is set equal to or greater than a discharge starting voltage, and applies an AC voltage to the second charging device such that a discharge current having a current quantity smaller than that in the second mode is supplied.

2. The image forming apparatus according to claim 1, wherein the control unit is configured to apply only the AC voltage to the second charging device without applying the primary transfer bias to the second primary transfer portion in a state where the first mode is executed.

3. The image forming apparatus according to claim 1, wherein the control unit is configured to apply a primary transfer bias to the first primary transfer portion in a state where the first mode is executed.

4. The image forming apparatus according to claim 3, wherein a primary transfer contrast at the first primary transfer portion in the first mode is the same as that in the second mode.

5. The image forming apparatus according to claim 1, further comprising a developer bearing member arranged at a position opposed to the first image bearing member, configured to bear a developer including toner and rotate, and to develop an electrostatic latent image on the first image bearing member by the toner in a state where a developing bias is applied, wherein the control unit is configured to stop rotation of the developer bearing member and apply the developing bias in a state where the first mode is executed.

6. The image forming apparatus according to claim 1, wherein, in a state where a continuous image forming job is executed in the first mode, the control unit is configured to form a primary transfer contrast equal to or greater than the discharge starting voltage to the first primary transfer portion at a timing in which a portion of the intermediate transfer body having passed the secondary transfer portion, with the secondary transfer bias applied, when the continuous image forming job is started reaches the first primary transfer portion.

7. The image forming apparatus according to claim 1, further comprising an abutting/separating mechanism configured to abut/separate the first and second image bearing members against/from the intermediate transfer body, wherein the control unit is configured to execute a third mode of forming a toner image on the third image bearing member and not forming a toner image on the first and second image bearing members, in a state where only the third image bearing member is abutted against the intermediate transfer body, and the first and second image bearing members are separated from the intermediate transfer body.

8. The image forming apparatus according to claim 7, wherein, in a state where a toner image is formed only on the third image bearing member, the control unit executes the first mode in a state where a total number of sheets of recording material having passed the secondary transfer portion is equal to or greater than a predetermined number of sheets, and executes the third mode in a state where the total number of sheets is less than the predetermined number of sheets.

9. The image forming apparatus according to claim 7, further comprising a humidity detection unit configured to detect humidity, wherein the control unit executes the first mode in a state where a detection result of the humidity detection unit is smaller than a predetermined value, and the control unit executes the third mode in a state where the detection result is equal to or greater than the predetermined value.

10. The image forming apparatus according to claim 7, wherein the control unit executes the first mode in a state where a continuous image forming job is performed, and the control unit executes the third mode in a state where an image forming job of a single sheet is performed.

11. The image forming apparatus according to claim 1, wherein the first through third image bearing members are included among a plurality of image bearing members, and the third image bearing member is an image bearing member arranged most downstream in the rotating direction of the intermediate transfer body among the plurality of image bearing members.

12. The image forming apparatus according to claim 11, wherein the first image bearing member is an image bearing member arranged most upstream with respect to the rotating direction of the intermediate transfer body among the plurality of image bearing members.

13. The image forming apparatus according to claim 11, wherein, in a state where the first mode is executed, AC voltage is applied to the image bearing members other than the first and third image bearing members among the plurality of image bearing members such that a discharge current having a smaller current quantity than that in the second mode is supplied.

14. The image forming apparatus according to claim 1, wherein the intermediate transfer body is an endless belt composed of a plurality of layers.

15. An image forming apparatus comprising:

a plurality of image forming portions including first and second image forming portions;

an intermediate transfer body onto which toner images formed by the plurality of image forming portions are transferred;

a secondary transfer member configured to transfer the toner images, which are transferred onto the intermediate transfer body, to a recording material at a secondary transfer portion;

a control unit configured to execute a first image forming mode and a second image forming mode; and an operation portion capable of setting an image forming mode to be executed by the control unit, wherein the first image forming portion comprises a first image bearing member on which a toner image is formed, a first charging device configured to charge a surface of the first image bearing member, and a first transfer device configured to transfer the toner image formed on the first image bearing member onto the intermediate transfer body, wherein the second image forming portion is arranged downstream of the first image forming portion and upstream of the secondary transfer member with respect to a moving direction of the intermediate transfer body, and comprises a second image bearing member on which a toner image is formed, a second charging device configured to charge a surface of the second image bearing member, and a second transfer device configured to transfer the toner image formed on the second image bearing member onto the intermediate transfer body, wherein the first image forming mode is a mode of performing image formation in a condition in which the first image bearing member is separated from the intermediate transfer body and the second image bearing member is contacted to the intermediate transfer body, wherein the second image forming mode is a mode of performing image formation in a condition in which the first and second image bearing members are contacted to the intermediate transfer body, and wherein, in response to an input of a job for continuously performing image formation, in which a toner image to be transferred to the recording material is formed on the second image bearing member and a toner image to be transferred to the recording material is not formed on the first image bearing member, on a number of recording materials equal to or greater than a predetermined number, the control unit is configured to execute the first image forming mode in case that the first image forming mode is set, through the operation portion, to be executed and to execute the second image forming mode in case that the second image forming mode is set, through the operation portion, to be executed.

16. The image forming apparatus according to claim 15, wherein a yellow toner image is formed on the first image bearing member and a black toner image is formed on the second image bearing member.

17. An image forming apparatus comprising:

an intermediate transfer body onto which toner images are transferred;

a first image bearing member on which a toner image to be transferred to the intermediate transfer body is formed;

a second image bearing member on which a toner image to be transferred to the intermediate transfer body is formed and is arranged downstream of the first image bearing member with respect to a moving direction of the intermediate transfer body;

a transfer member to which a transfer bias is applied and which is configured to transfer the toner image formed on the first image bearing member onto the intermediate transfer body;

a control unit configured to execute an image forming mode, the image forming mode including:

a first mode of performing image formation in a condition in which the first image bearing member is separated from the intermediate transfer body and the second image bearing member is contacted to the intermediate transfer body, and a second mode of performing image formation in a condition in which the first and second image bearing members are contacted to the intermediate transfer body and a voltage equal to or greater than a discharge starting voltage is applied to the transfer member; and an operation portion configured to manually input a setting for the image forming mode to be executed by the control unit, wherein, in response to an input of a job for continuously performing image formation, in which a toner image to be transferred to a recording material is formed on the second image bearing member and a toner image to be transferred to the recording material is not formed on the first image bearing member, on a number of recording materials equal to or greater than a predetermined number, the control unit is configured to execute the first mode in case that the first mode is set, through the operation portion, to be executed and to execute the second mode in case that the second mode is set, through the operation portion, to be executed.

* * * * *